US010488007B2

(12) United States Patent
Mayer et al.

(10) Patent No.: US 10,488,007 B2
(45) Date of Patent: Nov. 26, 2019

(54) COMPONENT HOUSING OF A VEHICLE HEADLIGHT

(71) Applicant: ZKW GROUP GMBH, Wieselburg (AT)

(72) Inventors: Matthias Mayer, Mank (AT); Markus Reinprecht, Pielachhauser (AT); Stefan Mitterlehner, Mank (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/080,743

(22) PCT Filed: Feb. 22, 2017

(86) PCT No.: PCT/AT2017/060041
§ 371 (c)(1),
(2) Date: Aug. 29, 2018

(87) PCT Pub. No.: WO2017/147632
PCT Pub. Date: Sep. 8, 2017

(65) Prior Publication Data

US 2019/0316752 A1 Oct. 17, 2019

(30) Foreign Application Priority Data

Mar. 3, 2016 (AT) ..... A 50169/2016

(51) Int. Cl.
*F21S 41/675* (2018.01)
*F21S 41/39* (2018.01)
*F21S 45/47* (2018.01)

(52) U.S. Cl.
CPC ..... *F21S 41/675* (2018.01); *F21S 41/39* (2018.01); *F21S 45/47* (2018.01)

(58) Field of Classification Search
CPC ..... F21S 41/675; F21S 41/39; F21S 45/47
See application file for complete search history.

(56) References Cited

U.S. PATENT DOCUMENTS 10,118,533 B2 * 11/2018 Yatsuda ..... B60Q 1/0076
2002/0109903 A1 * 8/2002 Kaeriyama ..... G02B 26/0841 359/290

(Continued)

FOREIGN PATENT DOCUMENTS

DE 102013103793 A1 10/2013
DE 102014109365 A1 1/2016

OTHER PUBLICATIONS

International Search Report for PCT/AT2017/060041, dated Jun. 13, 2017 (10 pages).

(Continued)

*Primary Examiner* — Mary Ellen Bowman
(74) *Attorney, Agent, or Firm* — Eversheds Sutherland (US) LLP

(57) ABSTRACT

The invention relates to a vehicle headlight comprising at least one light source, at least one projection optical system, and an electronic component (1) with an active optical surface on a front face, an active thermal surface, and electric contacts. A component housing (110), which is made of a housing shell (120) and a housing cover (150), a first printed circuit board (130) and at least one first spacer (160) are also contained. The component housing (110) at least partly receives the electronic component (1). The housing shell (120) comprises an assembly position for the electronic component (1) and a component opening (121) which is located in the region of the assembly position, in which the electronic component (1) is arranged, and by means of which the active optical surface of the electronic component (1) can be accessed. The electronic component (1) can be connected to the first printed circuit board (130) via the electric contacts of the electronic component. The housing shell (120) can be closed by the housing cover (150). The at least one first spacer (160) is arranged between a paired support point and the housing cover (150), wherein the (Continued)

Figure 1:
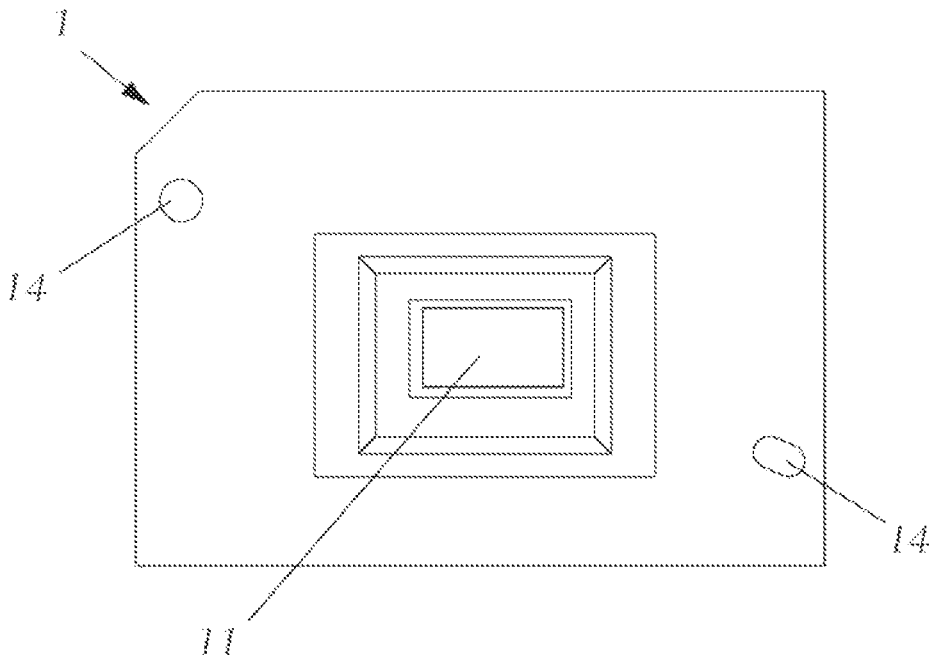

support point lies on the first printed circuit board (130), and at least one connection element is provided for producing a connection between the housing cover (150) and the housing shell (120), said connection element being introducible preferably along an axis which runs transversely to the printed circuit board (130).

18 Claims, 11 Drawing Sheets

(56) References Cited

U.S. PATENT DOCUMENTS

| | | | | |
|---|---|---|---|---|
| 2005/0117364 | A1* | 6/2005 | Rennick | B60R 1/1207 362/540 |
| 2010/0238417 | A1* | 9/2010 | Streppel | G03B 21/006 353/84 |
| 2013/0130674 | A1* | 5/2013 | De Wind | B60Q 1/2619 455/420 |
| 2015/0234177 | A1* | 8/2015 | Ishikawa | G02B 26/0858 359/200.8 |
| 2017/0057399 | A1 | 3/2017 | Yatsuda et al. | |

OTHER PUBLICATIONS

Office Action for Austrian Application No. A 50169/2016, dated Feb. 15, 2017 (3 pages).

* cited by examiner

COMPONENT HOUSING OF A VEHICLE HEADLIGHT

The invention relates to a vehicle headlight comprising at least one light source, at least one projection optical system, an electronic component with an active optical surface on a front face, an active thermal surface, and electric contacts on a rear face facing away from the front face, wherein the light source is designed to generate a light beam which is directed towards the active optical surface and is reflected there in the direction of the at least one projection optical system and forms a light pattern in front of the vehicle.

In the development of current headlight systems, there is an increasing focus on the desire to project a light pattern of the highest resolution possible onto the roadway, which light pattern changes quickly and can be adapted to the particular traffic, road and light conditions. The term "roadway" is used here for simplified representation, because of course it is dependent on the local conditions as to whether the light pattern actually is located on the roadway or also extends therebeyond. In principle, the light pattern is described on the basis of a projection onto a vertical surface, in accordance with the relevant standards which relate to motor vehicle illumination technology.

In order to meet the above requirement, headlights have been developed, inter alia, in which a reflector surface which can be controlled in a variable manner is formed from a plurality of micromirrors and reflects a light emission, generated by a light source, in the irradiation direction of the headlight. Lighting arrangements of this kind are advantageous in automotive construction due to their very flexible light distribution, since the illumination intensity can be controlled individually for different lighting areas and arbitrary light distributions can be realised, for example a dipped beam light distribution, a turning beam light distribution, an urban mode light distribution, a motorway mode light distribution, a cornering beam light distribution, a full beam light distribution, or the imaging of glare-free full beam.

For the micromirror assembly, what is known as the digital light processing (DLP®) projection technique is used, in which images are produced by modulating a digital image onto a light beam. Here, by means of a rectangular arrangement of movable micromirrors, also referred to as pixels, the light beam is broken down into sub-areas, and is then reflected pixel by pixel either into the projection path or out of the projection path.

The basis for this technique is formed by an electronic component which contains the rectangular arrangement in the form of a matrix of mirrors and the control technology therefor, and is referred to as a "digital micromirror device" (DMD).

A DMD microsystem is a spatial light modulator (SLM) which consists of micromirror actuators arranged in the form of a matrix, that is to say tiltable reflective surfaces, for example with an edge length of approximately 16 μm. The mirror surfaces are constructed in such a way that they are movable as a result of the action of electrostatic fields. Each micromirror is individually adjustable in respect of its angle and generally has two stable end states, it being possible to change between these up to 5000 times within the space of a second. The number of mirrors corresponds to the resolution of the projected image, wherein a mirror can represent one or more pixels. In the meantime, DMD chips with high resolutions in the megapixel range have become available. The technology forming the basis of the adjustable individual mirrors is micro-electrical-mechanical system (MEMS) technology.

Whereas DMD technology has two stable mirror states and the reflection factor can be adjusted by modulation between both stable states, the "analog micromirror device" (AMD) technology has the property that the individual mirrors can be adjusted in variable mirror positions, which are each in a stable state.

A typical micromirror component comprises a housing, on the front side of which, behind an optical viewing window, the matrix of mirrors as arranged. The active optical surface of a micromirror component of this kind is understood to mean the active mirror surface of the component, that is to say the total surface formed by all individual micromirrors. The electric contacts are usually arranged on the rear face of the housing, in a ring around a centrally arranged area provided for connection of a cooling device. The active thermal surface of a micromirror component of this kind is understood to mean the surface on the rear face of the components intended for attachment of a heat sink.

Often, the micromirror component is installed in what is known as a CLGA (ceramic land grid array) module, that is to say a connection system for integrated circuits. In an LGA system the connections of the integrated circuit are formed on the underside of said circuit in the form of a chequerboard field ("grid array") of contact areas ("lands"). LGA processors are usually placed on bases which contain springy contacts, which results in a lower mechanical loading of the contacts. The ceramic body of the CLGA is designed in particular for high operating temperatures.

Besides the mechanical loading forces that can occur during the assembly of the individual components, mechanical loading forces such as vibrations or tensile or compressive forces caused by driving situations and acting on all components in the vehicle can occur when the vehicle is at a standstill or when it is travelling. There is thus a need on the one hand for the components to be formed in such a way that mechanical loading forces have no influence on their function or arrangement relative to one another. On the other hand, the components must not be compromised in respect of stability or service life, for example by mechanical loading forces caused by high temperature differences on account of different material expansions of adjacent different materials at and within the components.

The object of the present invention lies in providing a component housing for an electronic component in a vehicle headlight which supports the basic optical function of the vehicle headlight by means of the inserted electronic component and also allows stable mechanical fastening thereof and the connection of the optical, electric and thermal system parts. Here, it must be taken into consideration that no mechanical loading forces should act on the connections. At the same time, simple maintenance of the components should be enabled. This object is achieved with a vehicle headlight of the type described at the outset, which includes a component housing which is made of a housing shell and a housing cover, a first printed circuit board, and at least one first spacer, and the component housing at least partly receives the electronic component, wherein:

- the housing shell comprises an assembly position for the electronic component and a component opening which is located in the region of the assembly position, in which the electronic component is arranged and by means of which the active optical surface of the electronic component can be accessed,
- the electronic component can be connected to the first printed circuit board via the electric contacts of the electronic component, the housing shell can be closed by the housing cover, the at least one first spacer is arranged between a paired support point and the housing cover, wherein the support point lies on the first printed circuit board or on a heat sink, which is arranged on the first printed circuit board and on the active thermal surface of the electronic component.

In addition, at least one connection element is provided for producing a connection between the housing cover and the housing shell, said connection element being introducible preferably along an axis which runs transversely to the first printed circuit board.

Access to an active optical surface or active thermal surface is understood to mean that the particular active surface can be reached through an opening either in the housing shell or in the printed circuit board or that the electronic component with the active surface can protrude through the opening in order to enable the effect of the active surface. The active optical surface produces its effect by reflection of light that is incident and is reflected again by the electronic component in accordance with the control unit. It is ensured by means of the opening that the path of incident and reflected light is not compromised. The active thermal surface produces its effect by the dissipation of heat produced in the electronic component. In order to improve the effect, a heat sink can additionally be mounted on the active thermal surface. The heat is produced on the one hand by the power dissipation of the electronics of the electronic component, but also by the light irradiated onto the active optical surface and not reflected, that is to say absorbed light.

As a result of the solution according to the invention a component housing is created which allows simple installation in the harsh environment of assembly in a vehicle headlight, and during operation keeps mechanical loads away from the sensitive electronic components and circuit carriers and at the same time provides a suitable interface of the optical function of the electronic component for the vehicle headlights. In particular, no forces act on the electronic component during the installation of the housing. In addition, the arrangement according to the invention enables easy assembly of the individual components and allows good accessibility for maintenance purposes during the product life cycle. Only the holder in which the imaging optical system is also installed has a rigid connection to the electronic component in order to hold the electronic component in a precise manner in the focal point of the imaging optical system. The component housing of the invention provides a robust unit, in which mechanical loading forces are dissipated, both during assembly and during operation.

The active optical surface of the electronic component can be accessed by means of the aforementioned component opening, i.e. the matrix of mirrors in the component is visible for the further components of the lighting arrangement and the light irradiated by a light source can be reflected in an undisturbed manner via the active optical surface.

In an advantageous development the first printed circuit board can comprise a heat sink opening, by means of which the active thermal surface of the electronic component can be accessed and improved cooling of the electronic component is attained. It is particularly favourable if the component housing comprises a heat sink which is arranged on the active thermal surface of the electronic component.

Similarly, it is also true for the aforementioned heat sink opening that it enables access to the active thermal surface of the electronic component in order to attach there a heat sink. The printed circuit board can consequently comprise an opening through which the heat sink can be plugged in position.

It is advantageous if support points lie on the first printed circuit board or on the heat sink so as to thus fix the heat sink to the printed circuit board when a heat sink is used.

In an advantageous embodiment it can be provided that at least the first spacer is springy and preferably has a substantially hollow-cylindrical form and an axis, wherein the connection element runs preferably through the hollow-cylindrical form and the axis of the connection element is preferably coincident with the axis of the first spacer.

If the first spacer is springy, a particularly suitable fastening or mechanical loading on the printed circuit board or the heat sink is achieved, in accordance with the problem addressed. In particular, dimensional tolerances of the used components can create mechanical stresses, such as bending loads, at the time of assembly. The springy elements ensure uniform contact forces at the time of assembly of the component housing and the components and also ensure that these are fixed with low distortion stress.

In a further aspect of the invention at least one second printed circuit board and at least one adapter can be arranged between the first printed circuit board and the housing cover, wherein the adapter preferably comprises a flexible printed circuit board and connects the printed circuit boards. Complex electronic circuits can thus be accommodated on the first and second printed circuit board. Some electronic components require comprehensive electronic circuits for control or sensor evaluation, which often implies a corresponding large size of the printed circuit board. In order to nevertheless keep the overall size compact, two or more printed circuit boards can be arranged one on top of the other in "piggyback" fashion.

It is favourable if the second printed circuit board is connected both electrically and mechanically to the first printed circuit board, and the second printed circuit board comprises openings through which the first spacers can protrude. The mechanical connection of the two printed circuit boards involves a simultaneous movability of both printed circuit boards, which is made possible by the first resilient spacer.

In order to achieve a simpler assembly of the electronic component, it can additionally be favourable if an assembly base is arranged between the first printed circuit board and the electronic component, whereby the electric contacts of the electronic component are connected for example to contact connection surfaces on the first printed circuit board. This is therefore particularly favourable in order to hold the electronic component adjustably with further components of the optical system of the vehicle headlight. The adjustment to other optical system parts is advantageous for example in order to position the electronic component exactly in the focal point of the imaging optical system.

In accordance with an additional aspect of the invention, which supports the compactness and mechanical stability, but in particular the simplicity of the component housing inclusive of the enclosed components, at least one second spacer can be inserted between the housing cover and the first spacer. The second spacer can preferably form a common component with the housing cover and can preferably have a substantially hollow-cylindrical form and an axis, wherein the connection element preferably runs through the hollow-cylindrical form and the axis of the connection element is preferably coincident with the axis of the second spacer.

It is favourable if the second printed circuit board comprises openings through which the second spacers can protrude.

It is furthermore additionally advantageous for the compactness and stability of the component housing if at least one third spacer is arranged between the housing shell and the first printed circuit board. The third spacer can preferably form a common component with the housing shell and can preferably have a substantially hollow-cylindrical form and an axis, wherein the connection element preferably runs through the hollow-cylindrical form and the axis of the connection element is preferably coincident with the axis of the third spacer.

The third spacer additionally ensures that the first printed circuit board is held at a distance from the housing shell. This is relevant in particular prior to the assembly of the component housing, since in the assembled state, that is to say when the holder is connected to the component housing, the holder of the electronic component is pressed into the component housing, wherein the spring force of the first spacer holds the arrangement under tension. Prior to the assembly of the component housing on the holder, the first printed circuit board could be pressed onto the housing shell without the third spacer, and electric short circuits could be brought about at circuits disposed on the first printed circuit board. The third spacer prevents short circuits of this kind through the housing shell, since an insulating gap is formed between the first printed circuit board and the housing shell. This protection against short circuits is relevant merely for test purposes after the assembly of the component housing and has no further function in the assembled state of the component housing. If no such test purposes are provided, it is possible to dispense with the third spacer.

The compactness and stability of the component housing can be further improved by arranging at least one fourth spacer between the heat sink and the first printed circuit board. The fourth spacer can preferably be springy and can preferably have a substantially hollow-cylindrical form and an axis, wherein the connection element preferably runs through the hollow-cylindrical form and the axis of the connection element is preferably coincident with the axis of the fourth spacer.

It has additionally proven to be particularly favourable for the compactness and stability, but in particular for the simplicity of the component housing, if at least one fifth spacer is arranged between a second spacer and the housing shell. The first spacer can preferably be arranged on the outer surface of the fifth spacer, and the fifth spacer can preferably form a common component with the housing cover and can preferably have a substantially hollow-cylindrical form and an axis, wherein the connection element preferably runs through the hollow-cylindrical form and the axis of the connection element is preferably coincident with the axis of the fifth spacer.

It is favourable if the second printed circuit board comprises openings through which the fifth spacers can protrude. The compactness and stability, but in particular the simplicity of the component housing can be additionally supported if at least one sixth spacer is arranged between the housing cover and second printed circuit board. The sixth spacer can preferably form a common component with the housing cover and can preferably have a substantially hollow-cylindrical form and an axis, wherein the connection element preferably runs through the hollow-cylindrical form and the axis of the connection element is preferably coincident with the axis of the sixth spacer. The sixth spacer can protect the printed circuit boards for example against short circuit in the event of direct contact with the component housing, should this be made of an electrically conductive material.

All of the above-mentioned spacers, which form a common component with the housing cover or the housing shell, can preferably be made of the same material as the housing cover or the housing shell itself. If an electrically conductive material is used for production thereof, it must be ensured that those points on the printed circuit boards which are in mechanical contact with these spacers take account of this circumstance by an appropriate wiring of the electronic circuits on the printed circuit boards, or that electrical insulation is provided.

In an additional aspect of the invention the component housing can be assembled particularly easily if at least one connection element is a screw, a plug-in connection or a bonded connection, wherein the connection element is preferably substantially cylindrical.

Connection elements, however, can be fixed or releasable depending on the requirements, which implies corresponding cost advantages in respect of component, assembly or maintenance costs. For releasable connections it is favourable if connection elements are screws. For fixed, particularly economical connections it is in turn favourable if connection elements are plug-in connections. Besides bonded connections, which have additional advantages in particular in respect of stability, economical rivets are also possible. For simple construction of the individual components, it is helpful if at least one connection element is substantially cylindrical. For example, screws are said to be substantially cylindrical even if they are formed in a manner tapering to a point. Threaded grooves, guide grooves or the like can also be provided on the connection elements, and can be formed continuously or also only in part along the entire surfaces of the connection elements. A variation of the diameter along the connection element can be advantageous, in particular in order to support simple assembly, since among other things it is the surface of the spacers that firstly ensures mechanical cohesion in the assembled state. With use of a number of connection elements a different design of the individual connection elements is possible. It is also possible that individual connection elements are guided through all spacers, but other connection elements are not guided through all spacers. A wide range of variations for assembly can thus be provided, which results in a particularly favourable and compact overall arrangement depending on the complexity and number of components within a component housing. A particularly favourable arrangement can be provided if three connection elements or spacers fix one or more printed circuit boards in the component housing, since a mechanical stress-free fastening of the printed circuit boards in the component housing is achieved, which has a positive effect on the service life of the components on the printed circuit boards and of the printed circuit boards themselves. For mechanically particularly stable arrangements, more than three connection elements or spacers can be used, which is favourable in particular when the used components, for example on the printed circuit board or the heat sink, have a large mass. In this case it is favourable if springy spacers are used at suitable points in order to reduce mechanical stresses in the printed circuit boards. Suitable points are for example positions at which, or in the vicinity of which large masses are secured. With use of more than three connection elements or spacers it is favourable if the component tolerances of for example printed circuit boards, heat sink fastenings or spacers are particularly precise in order to minimise the risk of mechanical stresses caused by an unfavourable, for example non-planar installation. It can be particularly favourable if at least four connection elements or spacers are used, in particular if an electronic component is used that has a substantially rectangular active optical surface and requires very precise alignment with other system parts, for example light sources, for example along or parallel to a horizontal and vertical axis. By the fixing by means of four connection elements or spacers, wherein two of these are arranged along or parallel to the horizontal axis and the other two of these are arranged along or parallel to the vertical axis, it is ensured that the electronic component is secured on a printed circuit board or in the assembly frame optimally with respect to vibrations for example or also undesirable thermal expansions, among other things of the CLGA housing of the electronic component, which is essential for the optical function of the arrangement.

For simple and rapid assembly of the component housing and the components contained therein, it is advantageous if the connection element at the same time mechanically connects a plurality of components to one another. By means of a combined assembly of this kind, cost advantages are achieved, as well as a smaller and more compact overall size or for example a particularly efficient cooling arrangement.

An additional development relates to the cooling of the component housing, wherein it is favourable if, as necessary, a powerful cooling apparatus of the heat sink is incorporated in a cooling line which has an inlet and an outlet and through which a cooling medium can be passed, and the housing shell preferably has an inlet opening and an outlet opening, wherein the inlet of the cooling line is arranged in the inlet opening and the outlet of the cooling line is arranged in the outlet opening.

As a result, an external cooling device can be connected particularly easily to the component housing. Depending on the necessary cooling power, air or water for example can be used as cooling medium and is moved through the cooling line by means of a fan or a pump. In order to ensure that the cooling device is sealed it is often manufactured conventionally as a metal cast part. The cooling inlet and cooling outlet can each comprise a flange so as to enable simple connection to further components of the cooling system. The use of seals in the flange region can additionally be useful depending on the cooling medium used.

In order to enable movements of the first printed circuit board when the component housing is assembled on a holder, it can be advantageous if the inlet opening and the outlet opening are embedded in the housing shell in a resiliently movable manner. This can be realised in the simplest case by seals.

In addition, a further aspect of the invention can ensure that the assembly of the component housing can be performed particularly easily by providing at least one spacer bracket on the outer face of the housing shell in the assembly region, which spacer bracket enables access to the active optical surface of the electronic component inserted into the component opening. The spacer bracket prevents the electronic component from detaching from the assembly base during assembly. This is advantageous since the electronic component in the assembly base mechanically has no mechanical connection of particularly high load-bearing capability and the electronic component could easily fall out from the assembly base, in particular during assembly of the individual parts. By means of the spacer bracket, the handling during assembly of the component housing and components contained therein is significantly improved. This can be important since a component housing of this kind is usually manufactured and assembled by a vehicle supplier, with the final assembly and connection to the vehicle systems being performed by the vehicle manufacturer, and favourable handling improves the assembly as a whole.

The spacer bracket can additionally perform the aforesaid function of the third spacer insofar as the first printed circuit board, when the component housing has been assembled together but is not yet assembled on the holder, is held at a distance from the housing shell. It is possible to dispense with the third spacer. If the electronic component rests on the spacer bracket, the spacer brackets can press the electronic component and consequently the first printed circuit board into the component housing when the component housing is assembled, since the first printed circuit board is fixedly connected to the electronic component. Here, the first printed circuit board is pressed away from the housing shell and held at a distance, wherein the spring force of the first spacer holds the arrangement under tension. As a result of this arrangement the effect of mechanical loading forces on the electronic component during the assembly of the component housing with the bracket can be significantly reduced, since these mechanical loading forces are taken up by the first, springy spacer.

Prior to the assembly of the housing on the holder, the first printed circuit board can be pressed onto the housing shell, which can bring about electric short circuits at circuits disposed on the first printed circuit board. As already described, the third spacer can reduce short circuits of this kind through the housing shell since an insulating gap is formed between the housing shell and the first printed circuit board. This protection against short circuits is usually relevant only for test purposes and has no further function in the assembled state of the housing. If no such test purposes are provided, it is possible to dispense with the third spacer.

Alternatively to the protection against short-circuits, an insulating gap can be formed between the housing shell and the first printed circuit board by the spacer bracket in that the distance of the spacer bracket from the outer face of the housing shell also determines the gap within the component housing between the first printed circuit board and the inner face of the housing shell in the assembled, but not yet final-assembled state. With appropriate selection of the dimensions of the spacer bracket, the same effect as a third spacer can be attained consequently, and the third spacer can be dispensed with in this case.

By use of an analogue or digital micromirror array as electronic component, a particularly advantageous embodiment of the optical function of the vehicle headlight is provided.

In an advantageous embodiment of the invention a simple assembly of the component housing with the vehicle headlight is supported in that said vehicle headlight comprises a housing system of a vehicle headlight. This housing system comprises the component housing and a holder for the component housing.

The assembly in a vehicle headlight is facilitated in a further aspect of the invention in that the holder is connected and secured to the housing shell at least by the connection element. Here, there is no need for a further component for fixing of the component housing. Consequently, a favourable connection is provided from a mechanical and also economical viewpoint. The housing shell is connected to a holder in such a way that the spacer bracket is exposed by a recess in the holder.

The holder can have at least one adjustment pin for alignment with the electronic component. The electronic component can have at least one corresponding adjustment opening. This can ensure simple adjustment of the optical components of the component housing with optical components of the vehicle headlight or of the housing system. This is therefore advantageous in particular since the electronic component should lie as exactly as possible in the focal point of an imaging lens arranged in the holder. To this end it is particularly advantageous if the holder comprises a holder opening, by means of which the active optical surface of the electronic component can be accessed.

It is clear that a suitable number of connection elements, spacers and openings supports the mechanical stability of the arrangement. However, depending on the requirements it is not always necessary for all connection elements to run through all spacers or openings in the various components or for additional connection elements to be necessary for stability reasons. It can thus be expedient if, with use of a heavy heat sink, said heat sink is fixed for example on the housing shell by means of additional connection elements, or on the other hand some of the spacers are omitted for cost or weight reasons.

Figure 2:
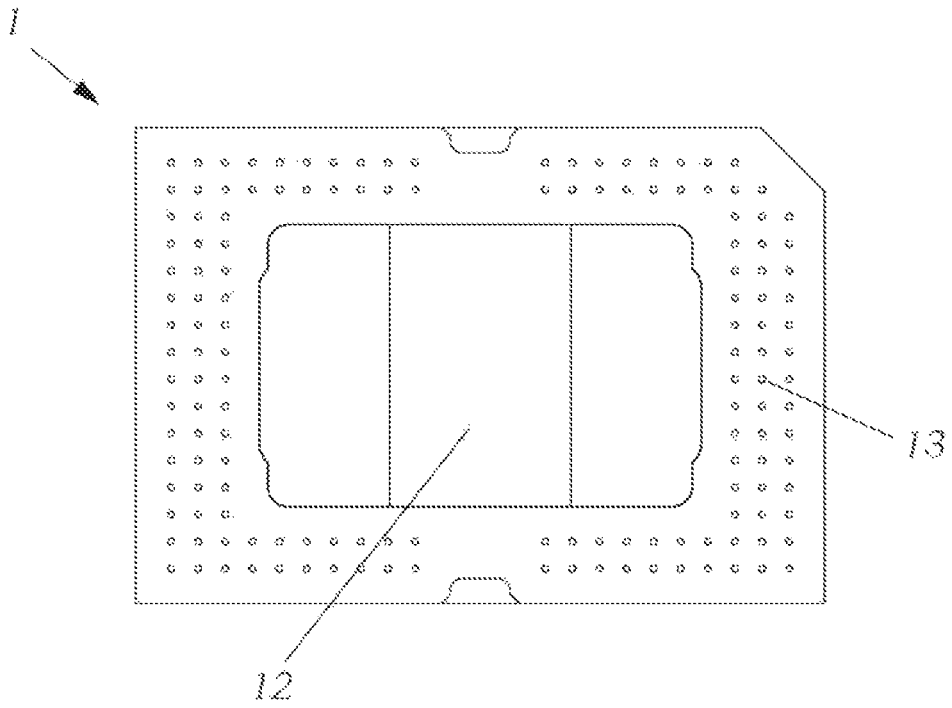
Figure 3:
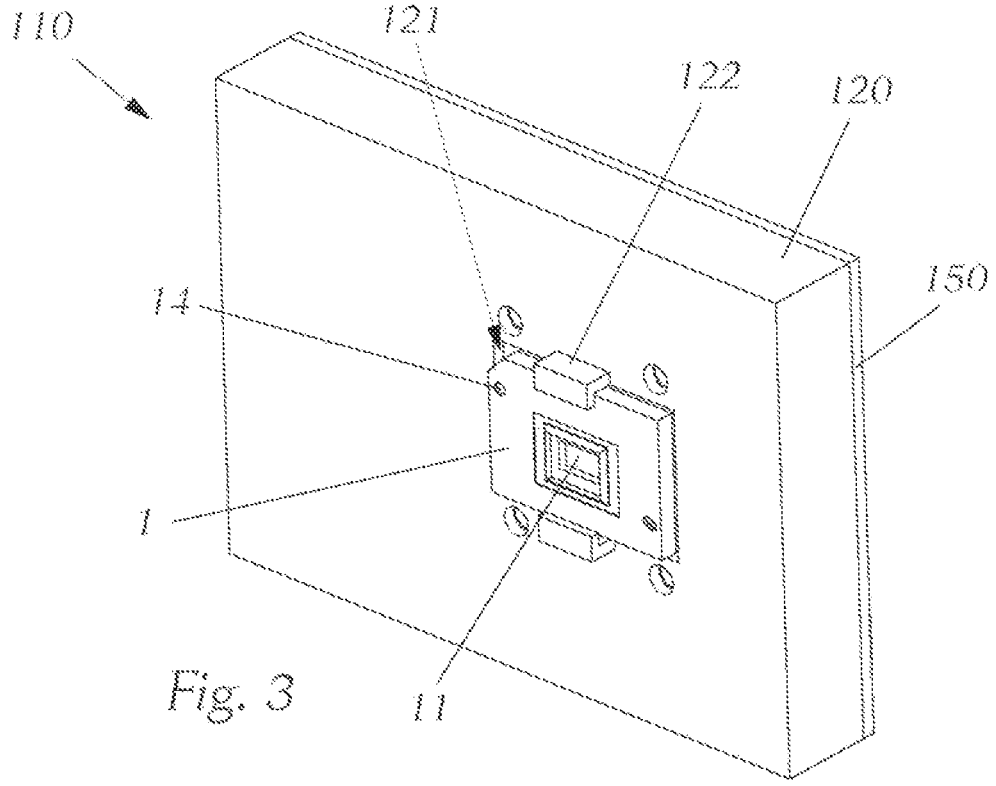
Figure 10:
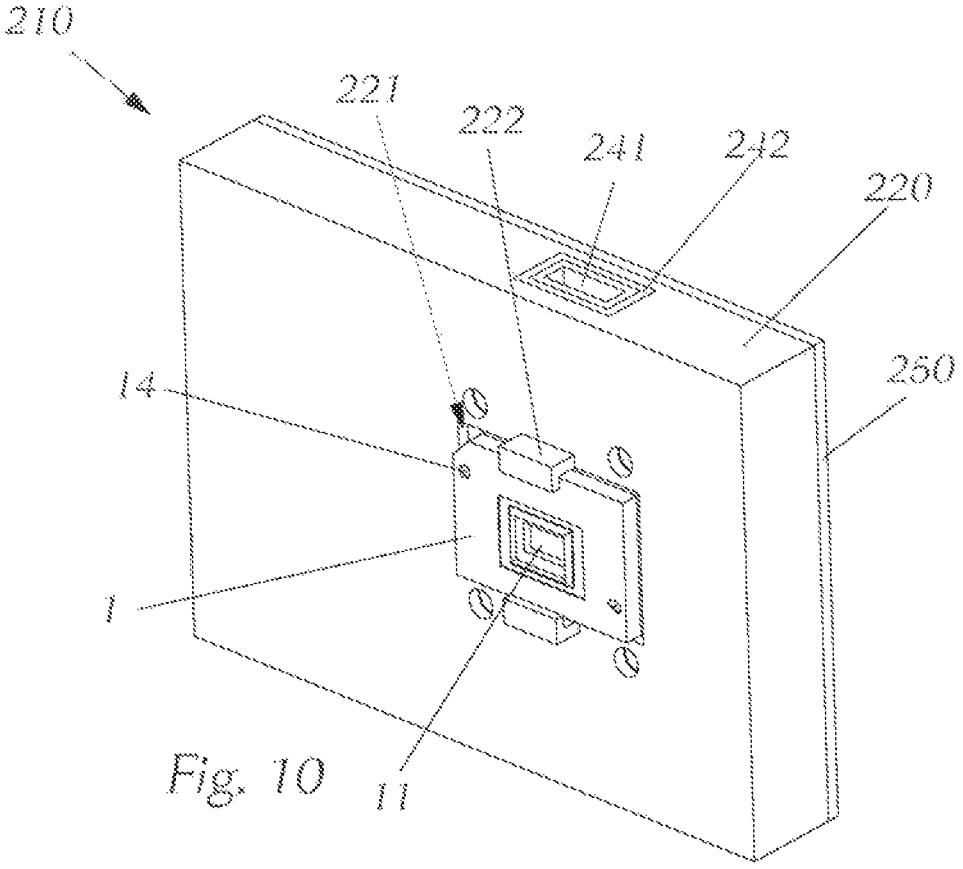
Figure 4:
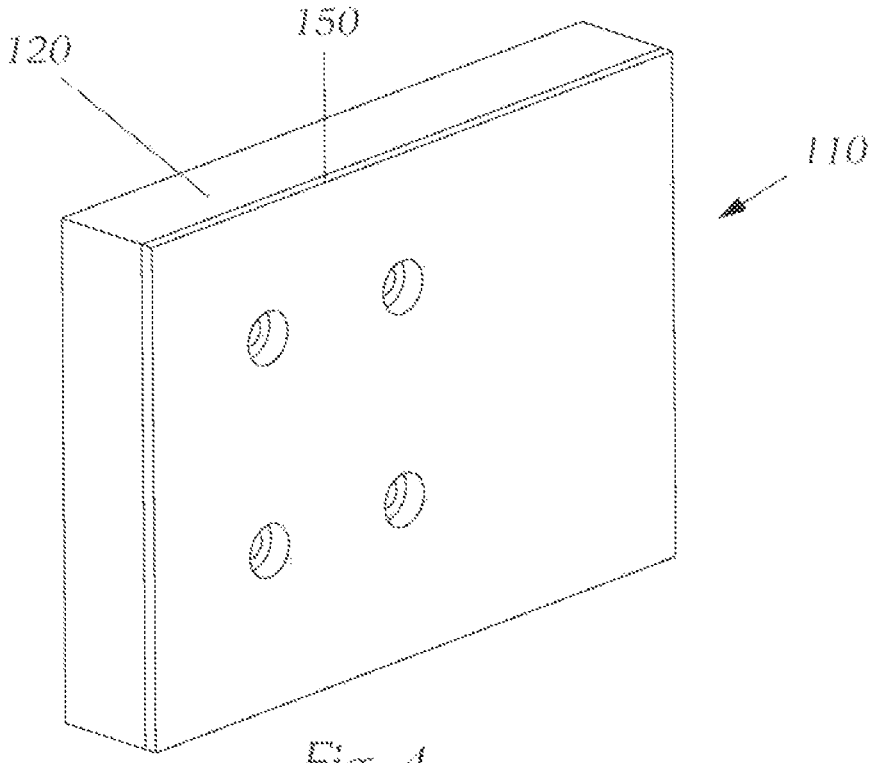
Figure 11:
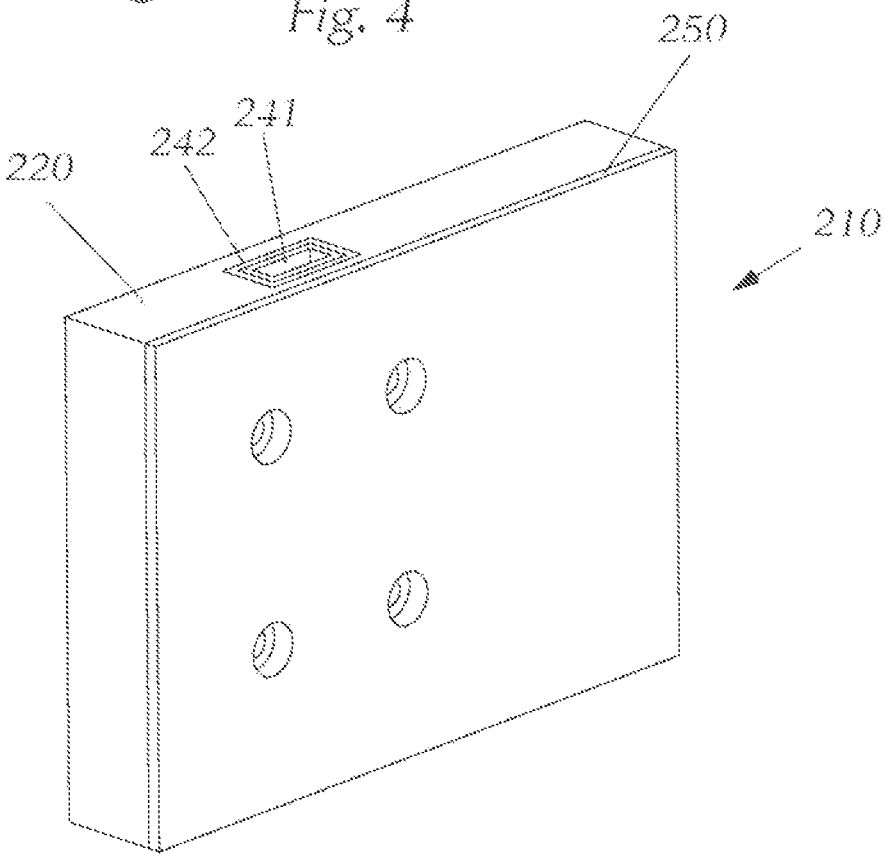
Figure 5:
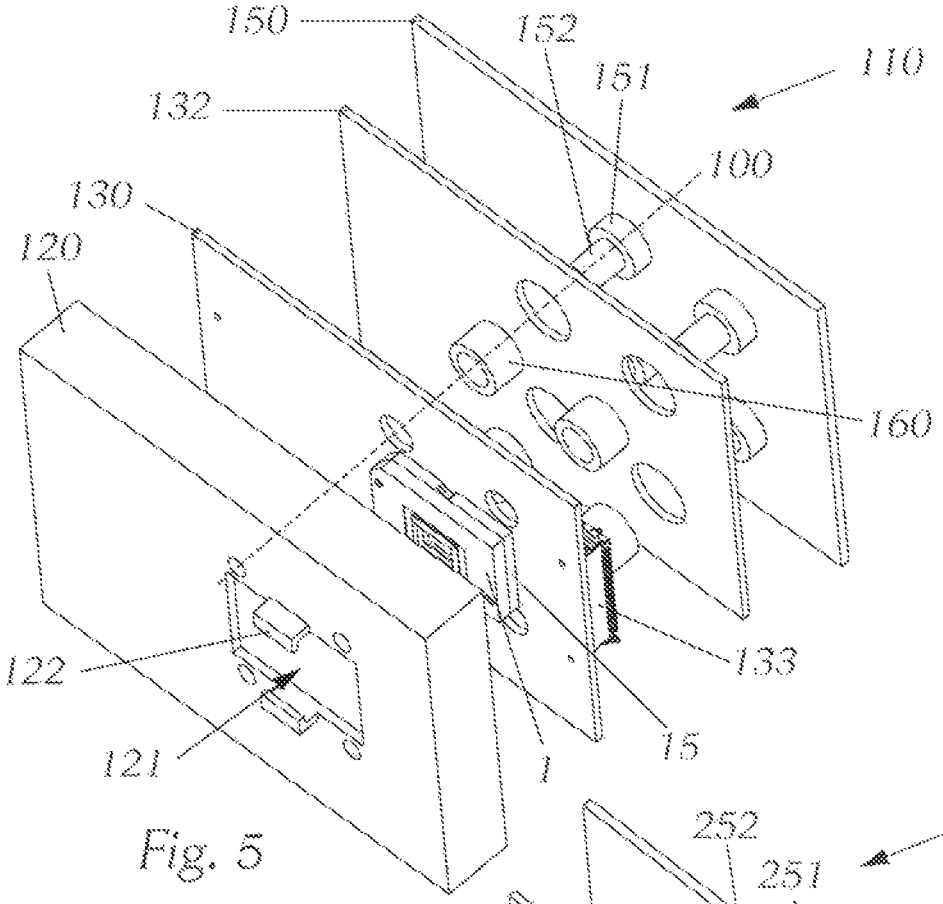
Figure 12:
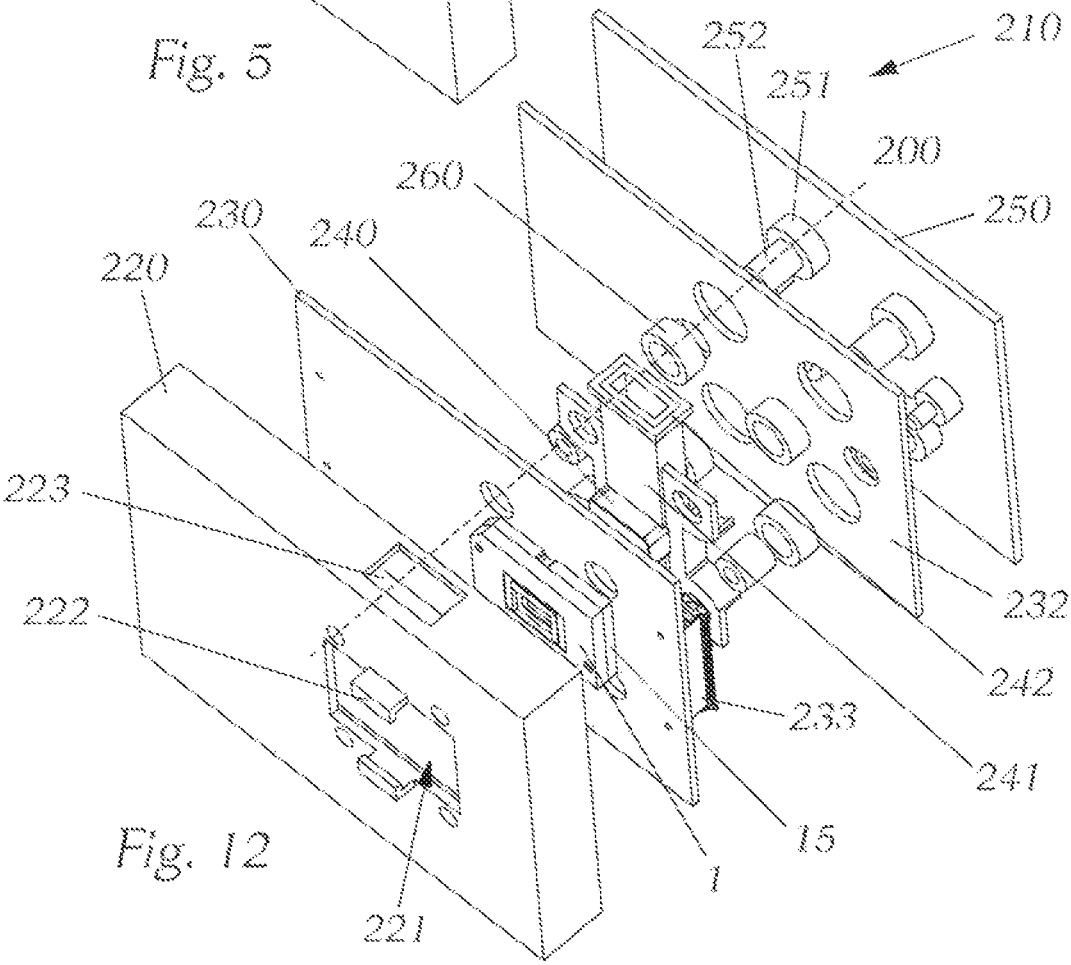
Figures 6, 13:
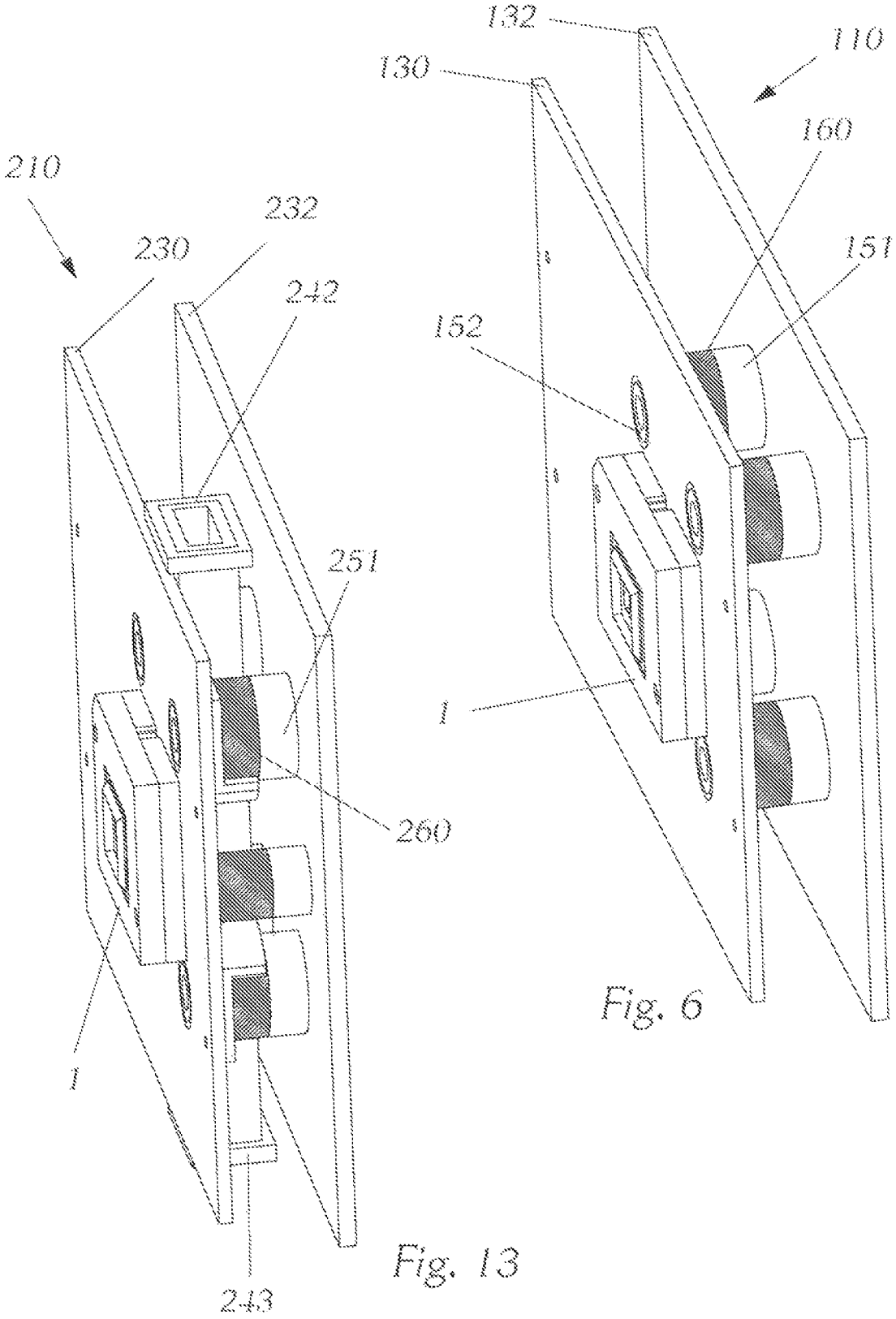
Figure 7:
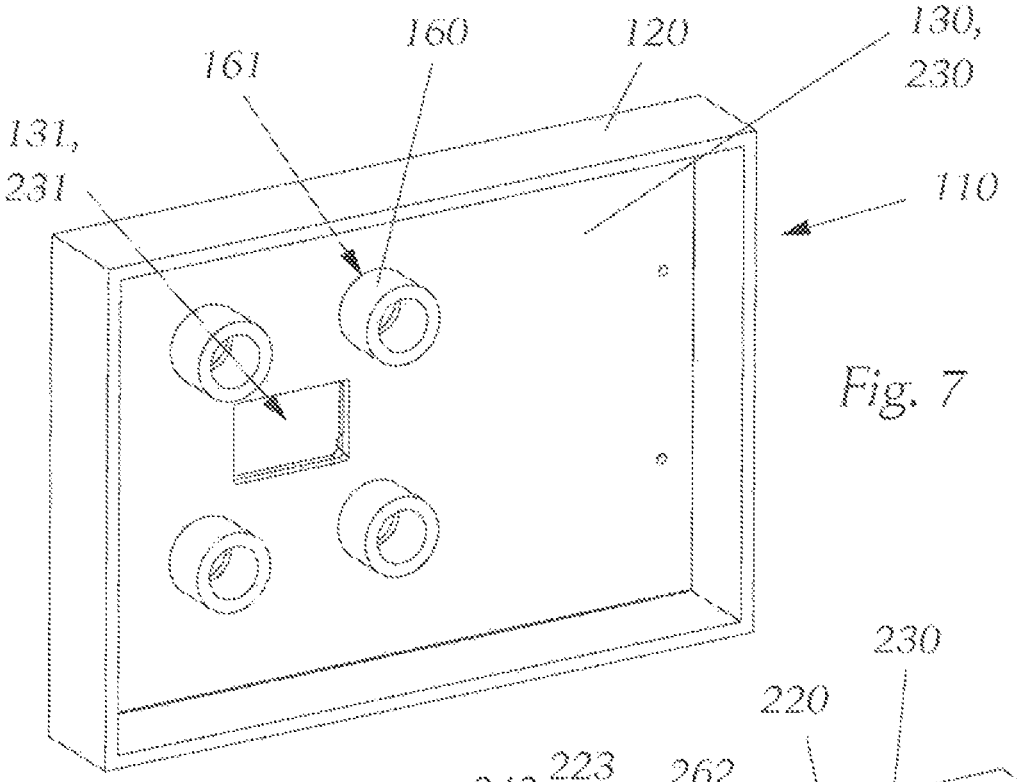
Figure 14:
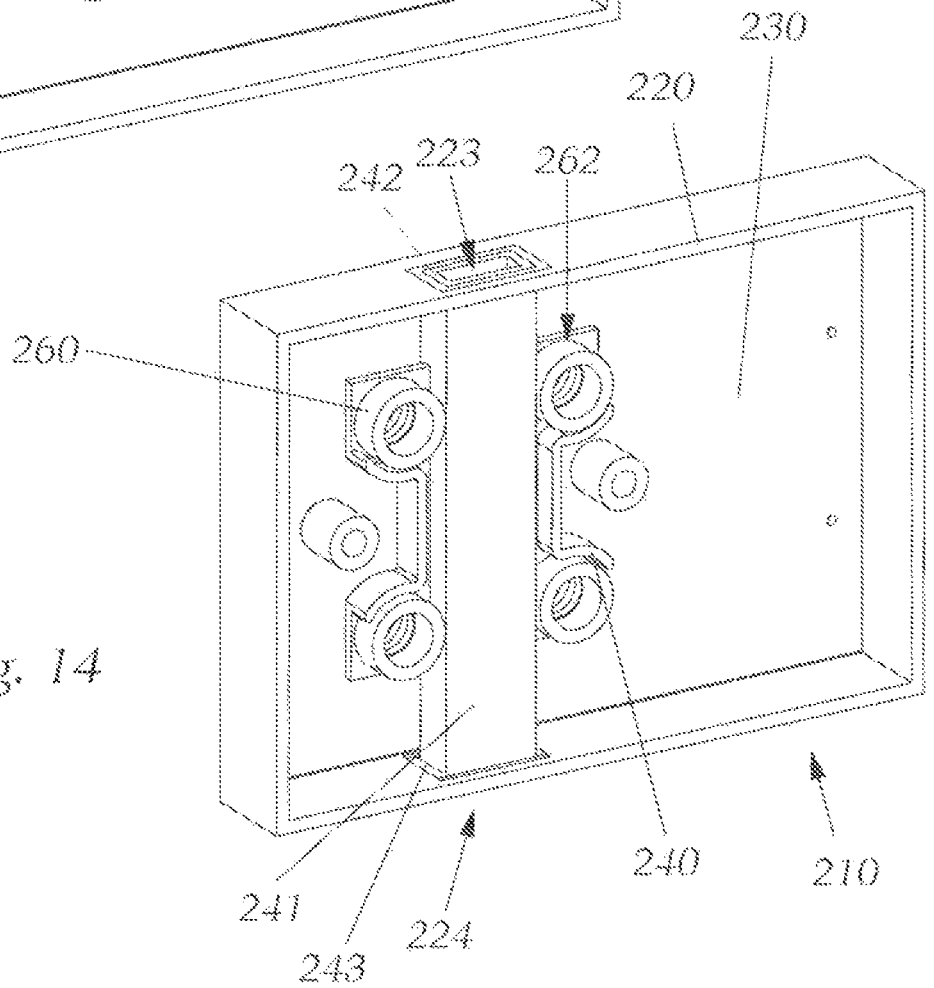
Figure 8:
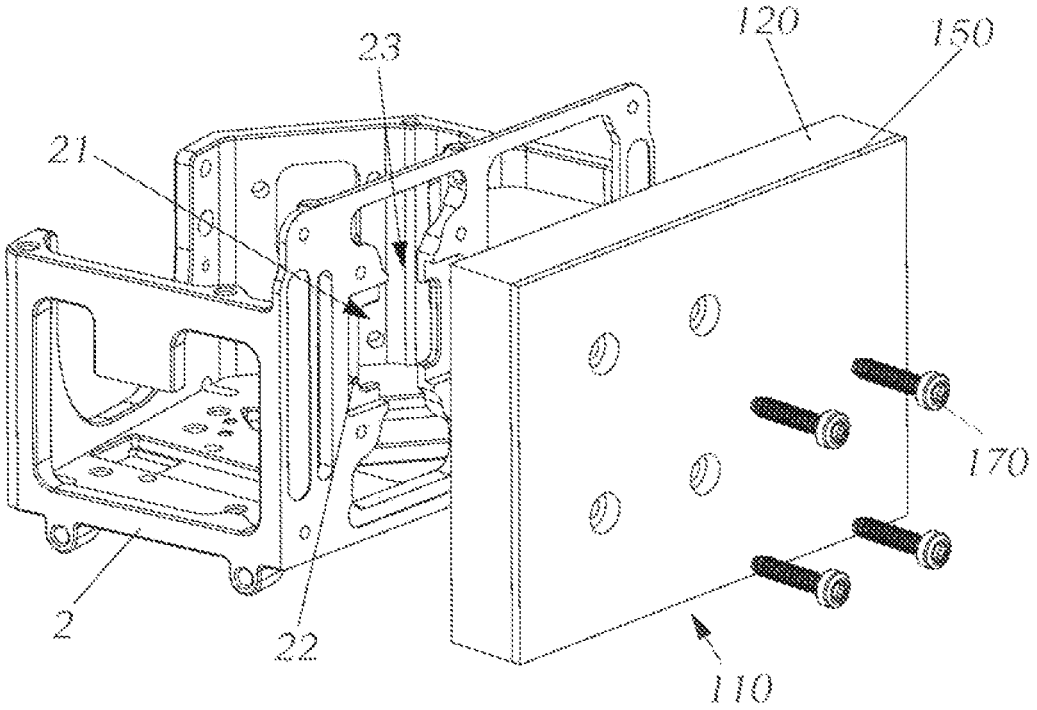
Figure 9:
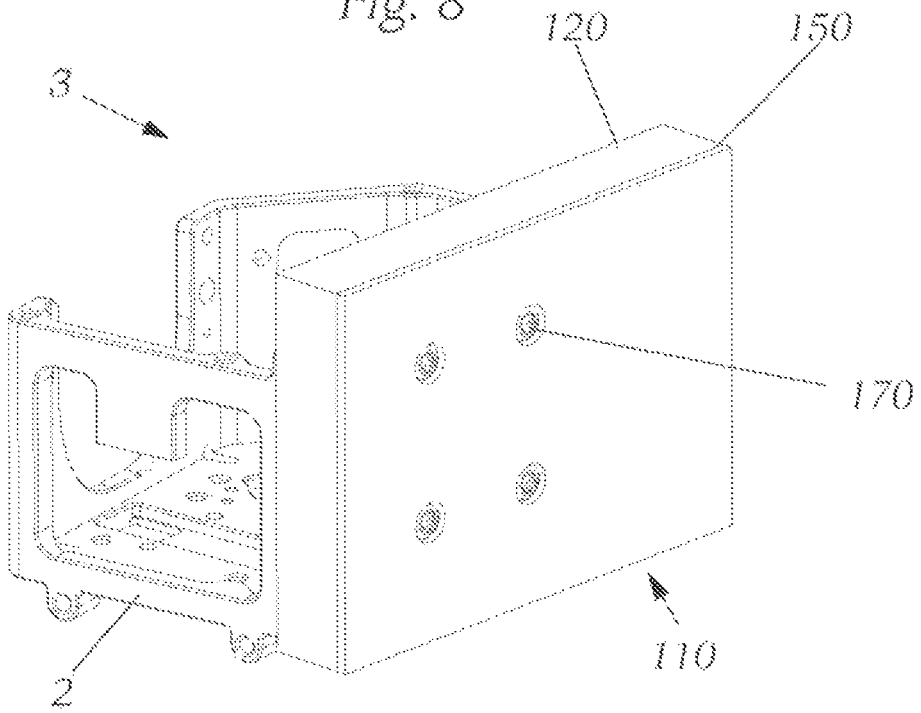
Figure 16:
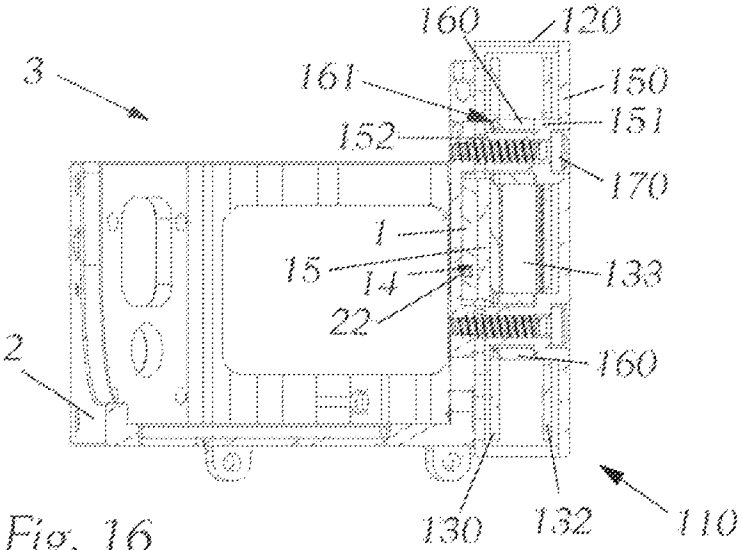
Figure 17:
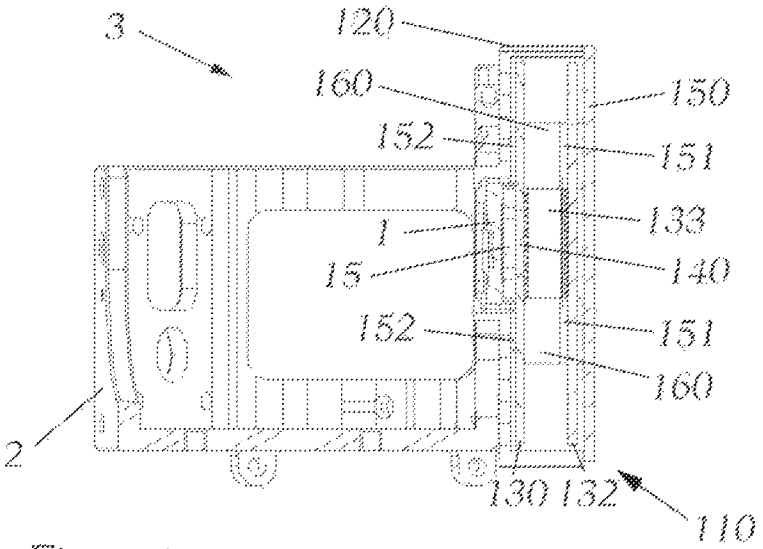
Figure 15:
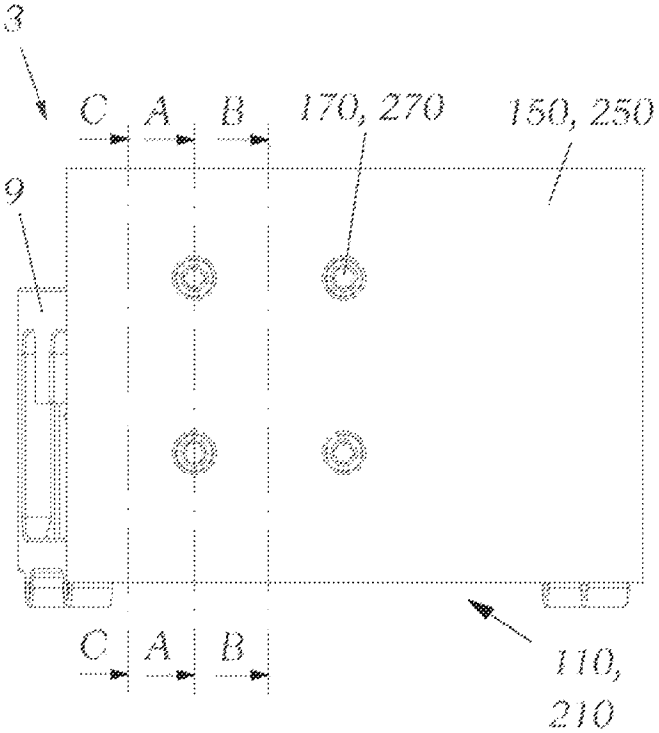
Figure 18:
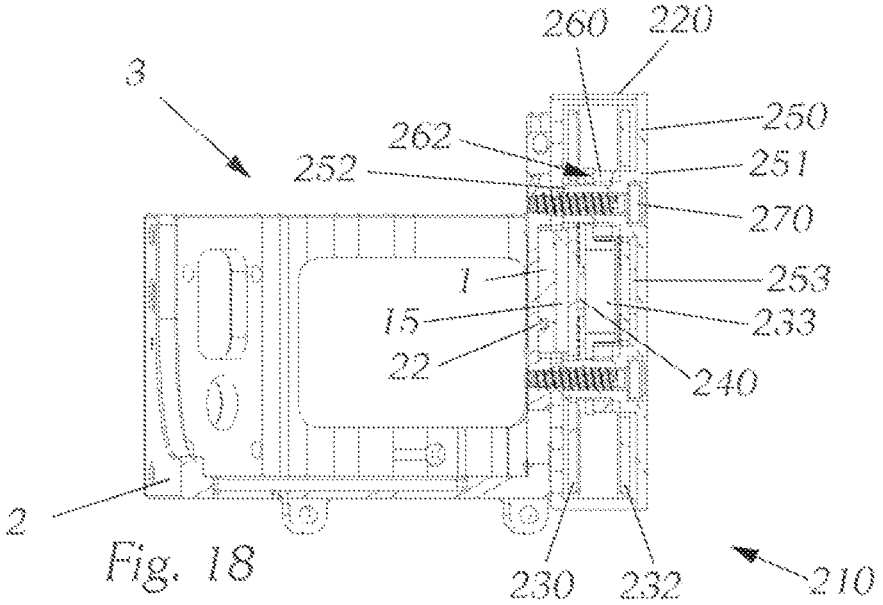
Figure 19:
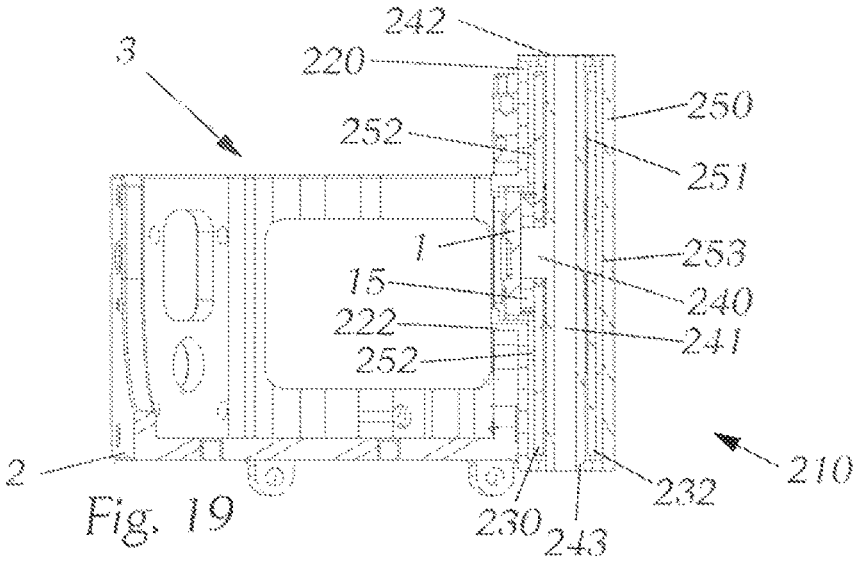
Figure 20:
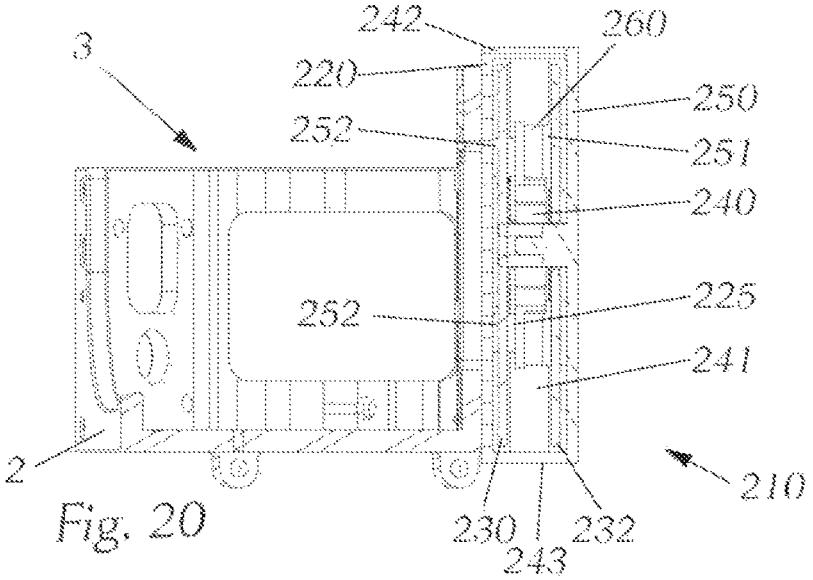
Figure 21:
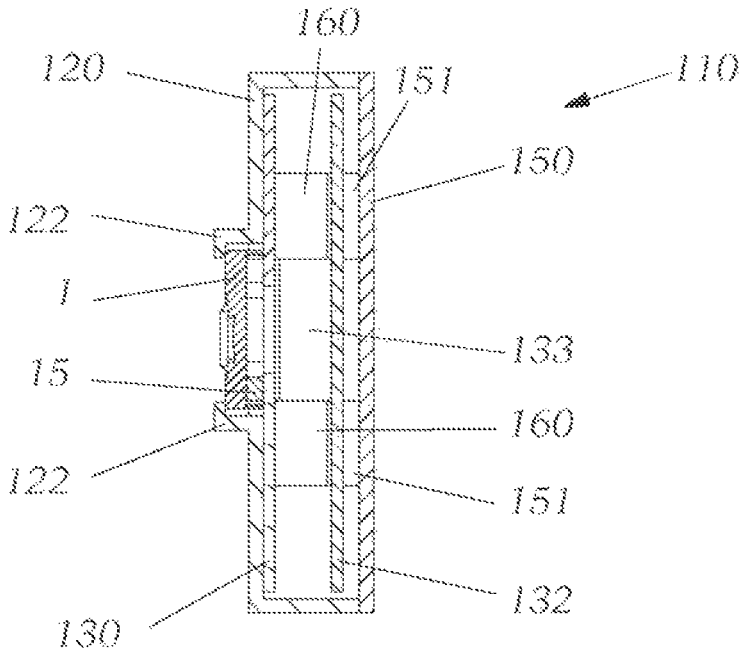
Figure 22:
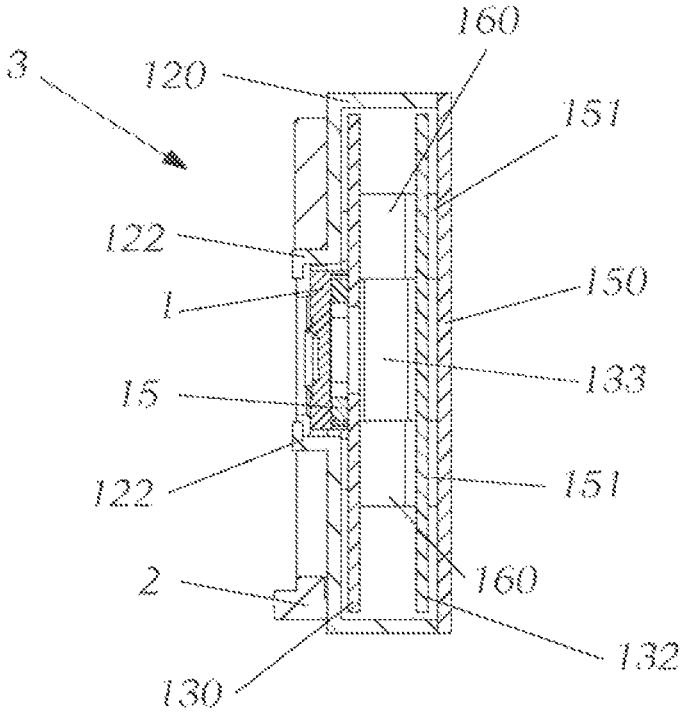
Figure 23:
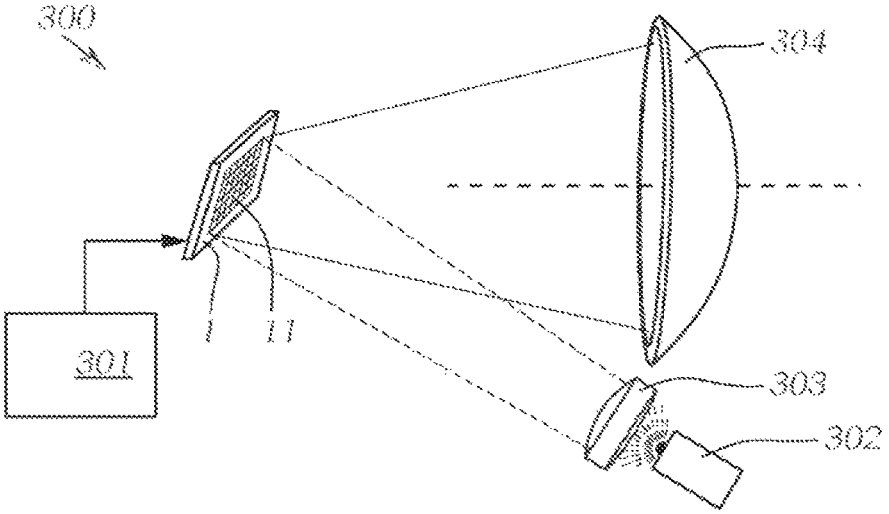
Figure 24:
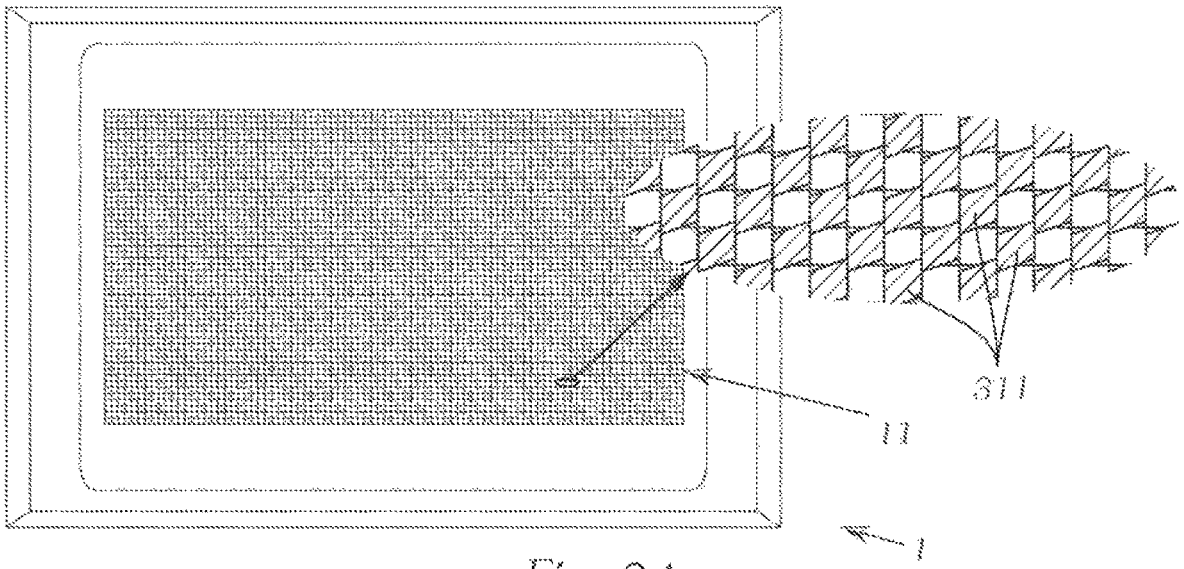

The invention and advantages thereof will be described in greater detail hereinafter on the basis of non-limiting exemplary embodiments, which are shown in the accompanying drawings, in which:

FIG. 1 shows a view of a chip upper face of an electronic component in accordance with an exemplary embodiment of the invention in the form of a DLP chip, FIG. 2 shows a view of a chip lower face of the electronic component, FIG. 3 shows a perspective view of a front face of an exemplary embodiment of the component housing according to the invention, FIG. 4 shows a perspective view of a rear face of the component housing, FIG. 5 shows an exploded illustration of the component housing and components thereof, FIG. 6 shows a perspective view of two printed circuit boards according to the invention, FIG. 7 shows a perspective view of the rear face of the housing shell with an inserted printed circuit board and springy spacers, FIG. 8 shows an exploded view of the component housing prior to assembly with a holder, FIG. 9 shows a perspective view of the component housing, which is connected to the holder, FIG. 10 shows a perspective view of a component housing according to the invention in an exemplary embodiment with cooling, FIG. 11 shows a perspective view from behind of the component housing according to FIG. 10, FIG. 12 shows an exploded view of the component housing and of the components according to FIG. 10, FIG. 13 shows a perspective view of two printed circuit boards according to FIG. 10, FIG. 14 shows a perspective view from behind of the housing shell according to FIG. 10 with an inserted printed circuit board, springy spacers, and a heat sink, FIG. 15 shows a view from behind of the component housing for both embodiments according to FIG. 3 and FIG. 10, which is connected to the holder, and the position of planes of section A-A, B-B and C-C, FIG. 16 shows a side view of the component housing according to FIG. 3 in the plane of section A-A according to FIG. 15, FIG. 17 shows a side view of the component housing according to FIG. 3 in a housing system in the plane of section B-B according to FIG. 15, FIG. 18 shows a side view of the component housing and the embodiment with cooling according to FIG. 10 in the plane of section A-A according to FIG. 15, FIG. 19 shows a side view of the component housing according to FIG. 10 in a housing system in the plane of section B-B according to FIG. 15, FIG. 20 shows a side view of the component housing according to FIG. 10 in a housing system in the plane of section C-C according to FIG. 15, FIG. 21 shows a side view of the component housing according to FIG. 3 in the plane of section B-B according to FIG. 15, FIG. 22 shows a side view of the component housing according to FIG. 3 in a housing system in the plane of section B-B according to FIG. 15, FIG. 23 shows a schematic illustration of a vehicle headlight, FIG. 24 shows an illustration of the chip upper face with an enlarged illustration of micromirrors.

Exemplary embodiments of the invention will now be explained in greater detail with reference to FIG. 1 to FIG. 23. In particular, parts that are important in a headlight for the invention are shown, wherein it is clear that a headlight contains many other parts, not shown, which enable expedient use in a motor vehicle, for example in particular a passenger car or motorbike. Only one representative reference sign for each component is shown in the figures, even if this component is provided in multiple.

In the figures the components of a component housing 110, 210 of a vehicle headlight 300 according to the invention are shown in an overview and in various perspectives and sections.

FIG. 1 and FIG. 2 show an electronic component 1 according to the invention in the form of an analogue or digital micromirror array (DLP chip). In FIG. 1 the electronic component 1 can be seen with its front face. The electronic component 1 here has an active optical surface 11 (micromirror array) and an adjustment opening 14. In FIG. 2 the electronic component 1 is shown with its rear face, which faces away from the front face and comprises an active thermal surface 12 and electric contacts 13 arranged in rings.

A first exemplary embodiment of a component housing 110 with the inner structure thereof can be seen in FIG. 3 to FIG. 9, whilst FIG. 10 to FIG. 14 show a further exemplary embodiment of a component housing 210 with the inner structure thereof, wherein a cooling apparatus for connection to an externally arranged cooling unit is provided. The reference signs in the second exemplary embodiment are denoted by "2xx" and correspond to those of the first exemplary embodiment which are denoted by "1xx", unless specified otherwise. For the sake of simplicity, the reference signs of the second exemplary embodiment will also be stated in the following description between parentheses in addition to the reference signs of the first exemplary embodiment.

With reference to FIG. 3 (FIG. 10), the component housing 110 (210) comprises a first housing shell 120 (220) with an assembly position for the electronic component 1. In the region of the assembly position there is also disposed a component opening 121 (221), in which the electronic component 1 is arranged. The active optical surface 11 of the electronic component 1 can be accessed by means of the component opening 121 (221). The housing shell 120 (220) can be closed by a housing cover 150 (250). The connection elements 170 (270) are used to establish connections between the housing cover 150 (250) and the housing shell 120 (see FIG. 8). The connection elements 170 (270) are each introduced along an axis arranged in each case along or parallel to a line 100 (200) (FIG. 5). Two spacer brackets 122 (222) are additionally arranged on the housing shell 120 (220).

FIG. 4 (FIG. 11) shows the closed component housing 110 (210), the housing shell 120 (220) and the housing cover 150 (250) in a perspective view from behind. Openings for passing through the connection element 170 (270) are additionally provided in order to fixedly connect the housing cover 150 (250) to the housing shell 120 (220) (see FIG. 8).

A detailed illustration of the inner structure of the component housing 110 is shown in the form of an exploded illustration in FIG. 5 (FIG. 12). The component housing 110 (210), in addition to the components already mentioned, also comprises a first printed circuit board 130 (230), which is connected to the electronic component 1 via the electric contacts 13 thereof and preferably via an assembly base 15. A plurality of support points 161 (see FIG. 7) are disposed on the first printed circuit board 130 (230). At least first spacers 160 (260) are arranged between the support points 161 and the housing cover 150 (250).

The first spacers 160 (260) are springy and each have a hollow-cylindrical form. The connection elements 170 (270) in each case pass through the hollow-cylindrical form, wherein in each case the axis of the hollow-cylindrical form of the connection elements 170 (270) is coincident with the axis of the first spacers 160 (260).

A second printed circuit board 132 (232) and also an adapter 133 (233), which can also comprise a flexible printed circuit board and which connects the printed circuit boards 130 (230) and 132 (232), are arranged between the first printed circuit board 130 (230) and the housing cover 150 (250).

The assembly base 15 is arranged between the first printed circuit board 130 (230) and the electronic component 1, whereby the electric contacts 13 of the electronic component 1 are connected to the first printed circuit board 130 (230).

Second spacers 151 (251) are incorporated between the housing cover 150 (250) and the first spacers 160 (260), form a common component with the housing cover 150 (250), and each have a hollow-cylindrical form. The connection elements 170 (270) in each case run through the hollow-cylindrical form, wherein the axis of the connection elements 170 (270) is coincident with the axis of the second spacers 151 (251).

The fourth spacer 225 (FIG. 20) is arranged only in the second exemplary embodiment and will be explained later in further detail.

Fifth spacers 152 (252) are arranged between the second spacers 151 (251) and the housing shell 120 (220). The first spacers 160 (260) are arranged on the outer surface of the fifth spacers 152 (252). The fifth spacers 152 (252) form a common component with the housing cover 150 (250) and in each case have a hollow-cylindrical form. The connection element 170 (270) run through the hollow-cylindrical form in each case, wherein the axis of the connection elements 170 (270) is coincident with the axis of the fifth spacers 152 (252).

Sixth spacers (253) are arranged between the housing cover 150 (250) and second printed circuit board 132 (232), form a common component with the housing cover 150 (250), and in each case have a hollow-cylindrical form. The connection elements 170 (270) each run through the hollow-cylindrical form, wherein the axis of the connection elements 170 (270) is coincident with the axis of the sixth spacers (253).

FIG. 6 shows a perspective view of the two printed circuit boards 130 (230) and 132 (232) and the spacers 160 (260) and 151 (251) arranged therebetween. The first spacers 160 (260) are arranged on the outer surface of the fifth spacers 152 (252), wherein the fifth spacers 152 (252) have a greater length than the first spacers 160 (260) and are guided through the printed circuit board 130 (230).

FIG. 7 shows a view from behind of the housing shell 120, and of the inserted printed circuit board 130 and the first spacers 160. The heat sink opening 131 in the first printed circuit board 130 is visible, whereby the active thermal surface 12 of the electronic component 1 can be accessed and is used here merely for the purpose of improved thermal radiation from the electronic component 1, since there is no heat sink used.

FIG. 8 shows a perspective view from the front of the closed component housing 110 (210) for assembly on a holder 2. A holder opening 21 for access to the active optical surface 11 of the electronic component 1, and an adjustment pin 22 for alignment with an adjustment opening 14 in the electronic component 1 are visible. FIG. 9 shows the assembled arrangement from FIG. 8, wherein the connection elements 170 (270) fixedly connect the housing cover 150 (250) to the housing shell 120 (220), and additionally fixedly connect the holder 2 to the housing shell 120 (220).

The arrangement described in this example is therefore favourable since the individual components are thus fastened to one another and held in position, and the mechanical loading forces are suitably damped, in accordance with the problem addressed.

The electronic component 1 is assembled in a holder 2 in the focal point of a subsequent imaging optical system (not shown here). To this end the holder 2 comprises a holder opening 21, whereby the active optical surface 11 of the electronic component 1 can be accessed.

The outer face of the housing shell 120 (220) has spacer brackets 122 (222) in the assembly region (see FIG. 3), wherein the active optical surface 11 of the electronic component 1 inserted into the component opening 121 (221), i.e. the "visible region", is not compromised. The housing shell 120 (220) is fixed to the holder 2, wherein the spacer brackets 122 (222) are exposed through a recess 23 in the holder 2.

The holder 2 has adjustment pins 22 for alignment with the electronic component 1, and the electronic component 1 has at least corresponding adjustment openings 14.

The connection element 170 (270) are screws in this exemplary embodiment, which are releasable and can be reused. This connection form facilitates the maintenance of the component housing; alternatively, connection elements that can be plugged in, clamped or bonded are possible.

FIG. 10 to FIG. 14 show a further exemplary embodiment of the component housing 210 with the inner structure thereof, wherein a cooling apparatus for connection to an externally arranged cooling unit is provided. The figures show a heat sink 240, which is arranged on the active thermal surface 12 of the electronic component 1 according to FIG. 2 connected to the first printed circuit board 230. The first printed circuit board 230 comprises a heat sink opening 231, by means of which the active thermal surface 12 of the electronic component 1 can be accessed. Otherwise, the information according to the embodiments in FIG. 3 to FIG. 9 applies similarly.

The heat sink 240 is incorporated in a cooling line 241 which has an inlet 242 and an outlet 243 and through which a cooling medium can be passed, and the housing shell 220 has an inlet opening 223 and an outlet opening 224, wherein the inlet 242 of the cooling line 241 is arranged in the inlet opening 223 and the outlet 243 of the cooling line 241 is arranged in the outlet opening 224.

The inlet opening 223 or the outlet opening 224 on the component housing 210 is used for connection to an external cooling unit, preferably a fan (not shown here). A pump is used in the event that the cooling medium is constituted by liquids.

Depending on the cooling requirement, which is based on the power loss of the electronic component 1, various cooling media can be used, for example air, preferably ambient air, or a liquid, preferably water or oil. The liquid can additionally contain antifreeze additives, for example.

The exemplary embodiment in FIG. 10 corresponds to the exemplary embodiment in FIG. 3, wherein a heat sink is additionally provided. In FIG. 10 the inlet 242 of the cooling line 241 in the component housing 210 is visible. In FIG. 11 the inlet 242 of the cooling line 241 in the component housing 210 is visible.

FIG. 12 shows, in the exemplary embodiment of the component housing with cooling, the inlet 242 of the cooling line 241, which is arranged in the inlet opening 223 of the housing shell 220. A plurality of support points 262 are defined on the heat sink 240, on which support points the sprung first spacers 260 rest.

FIG. 13 shows the first printed circuit board 230 with the electronic component 1, which can be mechanically connected to the second printed circuit board 232 by means of the connection elements 270 via spring and hollow-cylindrical first spacers 260. The outlet 243 of the cooling line 241, which is arranged in the outlet opening 224 of the housing shell 220, can be seen.

FIG. 14 shows the rear view of the component housing 210 with housing shell 220, inserted printed circuit board 230, and the first spacers 260. A heat sink 240 is incorporated in the printed circuit board 230 and forms a common component with a cooling line 241, wherein the cooling line 241 comprises an inlet 242 and an outlet 243. The inlet 242 is guided through the inlet opening 223 in the housing shell 220, and the outlet 243 is guided through the outlet opening 224 in the housing shell 220. The heat sink 240 is arranged on the active thermal surface 12 of the electronic component 1. The support points 262 lie on the heat sink 240.

FIG. 15 illustrates the position of planes of section A-A, B-B and C-C through the component housing 110 of the first exemplary embodiment, and the component housing 210 of the second exemplary embodiment. The plane of section A-A runs through the connection elements 170, 270. The plane of section B-B runs through the electronic component 1, and the plane of section C-C runs remotely from the electronic component 1 through the component housing 110, 210.

FIG. 16 shows the inner structure of the component housing 110 in accordance with the plane of section A-A according to FIG. 15. Here, the extent of the second spacers 151 and of the fifth spacers 152 are visible in particular, as well as the arrangement of the first spacers 160 on the outer surface of the fifth spacers 152 and the position of the support points 161.

The adjustment pins 22 with their corresponding adjustment openings 14 are visible, as are the screw connections by the connection elements 170, the printed circuit boards 130, 132, and the spacers 160, 260, 151, 152. It is clear that corresponding openings are provided for guiding the connection elements through spacers, printed circuit boards, heat sinks and housing components.

The inner structure of the component housing 110 along the plane of section B-B according to FIG. 15 is shown in FIG. 17.

The inner structure of the component housing 210 in accordance with the plane of section A-A according to FIG. 15 is shown in FIG. 18, wherein the example comprises a heat sink 240, which is arranged on the active thermal surface 12 of the electronic component 1, and an external cooling unit (not shown) can ensure active cooling, for example by means of a fan.

FIG. 19 shows the inner structure of the component housing 210 in accordance with the plane of section B-B according to FIG. 15, which runs through the electronic component 1 and the heat sink 240 with the cooling line 241, wherein the sixth spacers 253 are shown, which form a common component with the housing cover 250 and are used to form a gap between the second printed circuit board 232 and the housing cover. The sixth spacers 253 can optionally be hollow-cylindrical, such that the connection elements 270 are guided through the sixth spacers 253, wherein the axes of the sixth spacers 253 can be arranged in each case along or parallel to the line 200.

Sixth spacers 253 are arranged between the housing cover 250 and second printed circuit board 232, form a common component with the housing cover 250, and in each case have a hollow-cylindrical form. The connection elements 270 in each case run through the hollow-cylindrical form, wherein the axis of the connection elements 270 is coincident with the axis of the sixth spacers 253.

FIG. 20 shows the inner structure of the component housing 210 in accordance with the plane of section C-C according to FIG. 15, wherein the fourth spacers 225 are arranged between the heat sink 240 and the first printed circuit board 230. The fourth spacers 225 each have a hollow-cylindrical form. The connection elements 270 run in each case through the hollow-cylindrical form, wherein the axis of the connection elements 270 is coincident with the axis of the fourth spacers 225.

If the fourth spacers 225 are springy, the effect of mechanical stresses acting on the heat sink 240, for example in the form of vibrations, can thus be reduced.

FIG. 21 and FIG. 22 show the function with assembly of the component housing 110 according to the invention. This is applicable analogously for both of the aforementioned exemplary embodiments.

FIG. 21 shows the assembled component housing 110 (210). The springy first spacers 160 (260) press the first printed circuit board 130 (230) against the housing shell 120 (220). The electronic component 1 bears against the two spacer brackets 122 (222).

If the component housing 110 (210) is assembled on the holder 2, it is evident on the basis of the previous figures and FIG. 22 that the electronic component 1 is pressed into the component housing 110 (210) by the holder in the region of the holder opening 21. The first spacer 160 (260) is compressed and the first printed circuit board 130 (230) is held at a distance from the housing shell 120 (22), wherein a counter force is exerted by the spring tension of the material of the first spacer 160 (260). The second printed circuit board 132 (232) is coupled both electrically and mechanically to the first printed circuit board via the adapter and is displaced in parallel with the first printed circuit board 130 (230).

The adjustment opening 14 in the electronic component 1 can receive the adjustment pin 22 of the holder 2, as can be seen on the basis of the previous figures, and the spacer brackets 122 (222) reach through the recesses 23 in the holder 2. The electronic component 1 now no longer bears against the spacer brackets 122 (222).

FIG. 23 shows a vehicle headlight 300 comprising the electronic component 1, an electronic control unit 301, a light source 302, a primary optical system 303, and a projection optical system 304. The shown arrangement is secured within a headlight housing (not shown) with the aid of the component housings 110 or 210 according to the invention in accordance with the previous figures.

FIG. 24 shows, in an enlarged view, the electronic component 1 having the active optical surface 11 formed from a plurality of micromirrors 311.

The electronic component 1 has the active optical surface 11. The light source 302 together with the primary optical system 303 can generate a light beam directed towards the electronic component 1. The electronic control unit 301 controls the electronic component 1 by electric signals in such a way that the micromirrors 311 in the electronic component 1 reflect the light beam at least partially in the direction of the projection optical system 304 in accordance with a desired light distribution that is to be irradiated by the vehicle headlight 1, and a light pattern according to the desired light distribution can thus be formed in front of the vehicle in the installed state.

The following reference signs will be used hereinafter:

1 electronic component
11 active optical surface of the electronic component
12 active thermal surface of the electronic component
13 electric contacts of the electronic component
14 adjustment opening of the electronic component
15 assembly base for the electronic component
2 holder
21 holder opening for electronic component in the holder
22 adjustment pin of the holder
23 recess in the holder
3 housing system
100, 200 line through assembly axis
110, 210 component housing
120, 220 housing shell
121, 221 component opening in housing shell
122, 222 spacer bracket
223 inlet opening in housing shell
224 outlet opening in housing shell
225 fourth spacer
130, 230 first printed circuit board
131, 231 heat sink opening in first printed circuit board
132, 232 second printed circuit board
133, 233 adapter between first and second printed circuit board
240 heat sink
241 cooling line
242 inlet of the cooling line
243 outlet of the cooling line
150, 250 housing cover
151, 251 second spacer
152, 252 fifth spacer
253 sixth spacer
160, 260 first spacer (springy, elastically deformable)
161 support point of the spacer on printed circuit board
262 support point of the spacer on heat sink
170, 270 connection element
300 vehicle headlight
301 electronic control unit
302 light source
303 primary optical system
304 projection optical system
311 micromirror

The invention claimed is:

1. A vehicle headlight (300) comprising:

at least one light source (302);

at least one projection optical system (304); and an electronic component (1) with an active optical surface (11) on a front face, an active thermal surface (12), and electric contacts (13) on a rear face, facing away from the front face, wherein the light source (302) is designed to generate a light beam which is directed towards the active optical surface (302) and is reflected there in the direction of the at least one projection optical system (304) and forms a light pattern in front of the vehicle, wherein a component housing (110, 210), which is made of a housing shell (120, 220) and a housing cover (150, 250), a first printed circuit board (130, 230) and at least one first spacer (160, 260) are also contained, and the component housing (110, 210) at least partly receives the electronic component (1), wherein:

the housing shell (120, 220) comprises an assembly position for the electronic component (1) and a component opening (121, 221) which is located in the region of the assembly position, in which the electronic component (1) is arranged, and by means of which the active optical surface (11) of the electronic component (1) can be accessed, the electronic component (1) can be connected to the first printed circuit board (130, 230) via the electric contacts of the electronic component, the housing shell (120, 220) can be closed by the housing cover (150, 250), the at least one first spacer (160, 260) is arranged between a paired support point (161, 262) and the housing cover (150, 250), wherein the support point (161, 262) lies on the first printed circuit board (130, 230) or on a heat sink (240), which is arranged on the first printed circuit board (130, 230) and on the active thermal surface (12) of the electronic component (1), wherein at least one connection element (170, 270) is provided for producing a connection between the housing cover (150, 250) and the housing shell (120, 220), said connection element being introducible preferably along an axis which runs transversely to the first printed circuit board (130, 230).

2. The vehicle headlight (300) according to claim 1, wherein the first printed circuit board (130, 230) comprises a heat sink opening (131, 231), by means of which the active thermal surface (12) of the electronic component (1) can be accessed.

3. The vehicle headlight (300) according to claim 1, wherein at least the first spacer (160, 260) is springy and preferably has a substantially hollow-cylindrical form, wherein the connection element (170, 270) runs preferably through the hollow-cylindrical form and the axis of the connection element (170, 270) is preferably coincident with the axis of the first spacer (160, 260).

4. The vehicle headlight (300) according to claim 1, wherein at least one second printed circuit board (132, 232) and at least one adapter (133, 233), which preferably comprises a flexible printed circuit board and which connects the printed circuit boards (130, 132, 230, 232), are arranged between the first printed circuit board (130, 230) and the housing cover (150, 250).

5. The vehicle headlight (300) according to claim 1, wherein an assembly base (15) is arranged between the first printed circuit board (130, 230) and the electronic component (1), whereby the electric contacts (13) of the electronic component (1) are connected to the first printed circuit board (130, 230).

6. The vehicle headlight (300) according to claim 1, wherein at least one second spacer (151, 251) is inserted between the housing cover (150, 250) and the first spacer (160, 260), wherein the second spacer (150, 251) preferably forms a common component with the housing cover (150, 250) and preferably has a substantially hollow-cylindrical form, wherein the connection element (170, 270) preferably runs through the hollow-cylindrical form and the axis of the connection element (170, 270) is preferably coincident with the axis of the second spacer (151, 251).

7. The vehicle headlight (300) according to claim 1, wherein at least one third spacer is arranged between the housing shell (120, 220) and the first printed circuit board (130, 230), wherein the third spacer preferably forms a common component with the housing shell (120, 220) and preferably has a substantially hollow-cylindrical form, wherein the connection element (170, 270) preferably runs through the hollow-cylindrical form and the axis of the connection element (170, 270) is preferably coincident with the axis of the third spacer.

8. The vehicle headlight (300) according to claim 1, wherein at least one fourth spacer (225) is arranged between the heat sink (240) and the first printed circuit board (130, 230), wherein the fourth spacer (225) is preferably springy and preferably has a substantially hollow-cylindrical form, wherein the connection element (170, 270) preferably runs through the hollow-cylindrical form and the axis of the connection element (170, 270) is preferably coincident with the axis of the fourth spacer (225).

9. The vehicle headlight (300) according to claim 6, wherein at least one fifth spacer (152, 252) is arranged between a second spacer (151, 251) and the housing shell (120, 220), wherein the first spacer (160, 260) is preferably arranged on the outer surface of the fifth spacer (152, 252) and the fifth spacer (152, 252) preferably forms a common component with the housing cover (150, 250) and preferably has a substantially hollow-cylindrical form, wherein the connection element (170, 270) preferably runs through the hollow-cylindrical form and the axis of the connection element (170, 270) is preferably coincident with the axis of the fifth spacer (152, 252).

10. The vehicle headlight (300) according to claim 4, wherein at least one sixth spacer (253) is arranged between the housing cover (150, 250) and second printed circuit board (132, 232), wherein the sixth spacer (253) preferably forms a common component with the housing cover (150, 250) and preferably has a substantially hollow-cylindrical form, wherein the connection element (170, 270) preferably runs through the hollow-cylindrical form and the axis of the connection element (170, 270) is preferably coincident with the axis of the sixth spacer (253).

11. The vehicle headlight (300) according to claim 1, wherein at least one connection element (170, 270) is a screw, a plug-in connection or a bonded connection, wherein the connection element (170, 270) is preferably substantially cylindrical.

12. The vehicle headlight (300) according to claim 1, wherein the heat sink (240) is inserted into a cooling line (241) which has an inlet (242) and an outlet (243) and through which a cooling medium can be passed, and the housing shell (220) preferably has an inlet opening (223) and an outlet opening (224), wherein the inlet (242) of the cooling line (241) is arranged in the inlet opening (223) and the outlet (243) of the cooling line (241) is arranged in the outlet opening (224).

13. The vehicle headlight (300) according to claim 1, wherein at least one spacer bracket (122, 222) is comprised in the assembly region on the outer face of the housing shell (120, 220) and enables access to the active optical surface (11) of the electronic component (1) inserted into the component opening (121, 221).

14. The vehicle headlight (300) according to claim 1, wherein the electronic component (1) is an analogue or digital micromirror array.

15. The vehicle headlight (300) according to claim 1, wherein a holder (2) is also comprised, wherein the holder (2) can be connected to the housing shell (120, 220) at least by the connection element (170, 270).

16. The vehicle headlight (300) according to claim 15, wherein the housing shell (120, 220) is connected to the holder (2) in such a way that the spacer bracket (122, 222) is exposed by means of a recess (23) in the holder (2).

17. The vehicle headlight (300) according to claim 15, wherein the electronic component (1) has at least one corresponding adjustment opening (14) and the holder (2) has at least one adjustment pin (22) for alignment with the adjustment opening (14) in the electronic component (1).

18. The vehicle headlight (300) according to claim 15, wherein the holder (2) comprises a holder opening (21), wherein the active optical surface (11) of the electronic component (1) can be accessed by means of the holder opening (21).

* * * * *